US005918938A

United States Patent [19]

Miotto

[11] Patent Number: 5,918,938

[45] Date of Patent: Jul. 6, 1999

[54] SAFETY DEVICE FOR MECHANISMS FOR LIFTING THE BACK OF A CHAIR OR ARMCHAIR

[75] Inventor: Beniamino Miotto, Roncade, Italy

[73] Assignee: Nowy Styl sp. z o.o., Krosno, Poland

[21] Appl. No.: 08/960,591

[22] Filed: Oct. 30, 1997

[30] Foreign Application Priority Data

Nov. 5, 1996 [IT] Italy ..... TV96A0140

[51] Int. Cl.[6] ..... A47C 7/54

[52] U.S. Cl. ..... 297/353; 297/411.36; 248/297.31

[58] Field of Search ..... 297/353, 411.36; 248/297.31, 297.21

[56] References Cited

U.S. PATENT DOCUMENTS

| | | | |
|---|---|---|---|
| 4,036,525 | 7/1977 | Howk | 297/353 |
| 4,043,592 | 8/1977 | Fries | 297/353 X |
| 4,384,742 | 5/1983 | Wisniewski | 297/353 |
| 4,616,877 | 10/1986 | Slaats | 297/353 |
| 4,639,039 | 1/1987 | Donovan | 297/353 |
| 4,749,230 | 6/1988 | Tornero | 297/353 |
| 4,930,840 | 6/1990 | Tornero | 297/353 |
| 5,007,678 | 4/1991 | Dekraker | 297/353 |
| 5,324,096 | 6/1994 | Schultz | 297/353 X |
| 5,582,460 | 12/1996 | Schultz | 297/353 |
| 5,586,809 | 12/1996 | Szmadzinski | 297/353 |
| 5,597,204 | 1/1997 | Karaus, Jr. | 297/353 |
| 5,649,741 | 7/1997 | Beggs | 297/353 |
| 5,678,893 | 10/1997 | Bock | 297/353 |
| 5,685,609 | 11/1997 | Miotto | 297/353 |
| 5,695,249 | 12/1997 | Lotfi | 297/353 |
| 5,765,920 | 6/1998 | Lai | 297/411.36 |

*Primary Examiner*—Peter M. Cuomo
*Assistant Examiner*—Rodney B. White
*Attorney, Agent, or Firm*—Daniel J. O'Byrne

[57] ABSTRACT

A safety device, particularly usable for mechanisms for lifting a back of a chair or armchair of the type that comprising a blade-like element which is slidingly associated between a first and a second supporting plate for a back; the blade-like element protrudes to the rear of, and above, a seat and has a first recess for a rack with two mutually opposite and offset sets of teeth, which interacts with a complementarily toothed ratchet element which cooperates with elements for forcing the locking of the sliding of the blade-like element as a consequence of a sudden movement imparted to the back in an upward or downward direction.

18 Claims, 7 Drawing Sheets

SAFETY DEVICE FOR MECHANISMS FOR LIFTING THE BACK OF A CHAIR OR ARMCHAIR

BACKGROUND OF THE INVENTION

The present invention relates to a safety device which is particularly usable for mechanisms for lifting a back of a chair or armchair.

Mechanisms for lifting a back, of the kind disclosed in Italian Utility Model application TV95U000016 dated Mar. 21, 1995, are currently known which comprise a blade-like element which is slidingly associated with a supporting plate for a back which protrudes to the rear of, and above, a seat.

The blade-shaped element has a first recess whereat a rack is associated; a complementarily toothed ratchet element interacts with said rack, can move only transversely to the rack and is forced toward it by a suitable spring.

This conventional solution, which also includes suitable means associated with the rack for temporarily uncoupling the ratchet with respect to said rack, allows to vertically adjust the back with respect to the seat but entails drawbacks: first of all, vertical adjustment of the back can be achieved only starting from the condition in which the back is at the lower stroke limit, and this condition occurs only if the back has been placed first at the upper stroke limit.

Only starting from this position it is in fact possible to quickly lower the back to the lower stroke limit; this occurs by virtue of the stable locking of the ratchet in a condition in which it does not interact with the rack. Moreover, the conventional device does not have antipanic or antishock characteristics, since if the ratchet is at the lower stroke limit, for example when the chair is moved by holding it by its back, the back may rise suddenly to its upper stroke limit and then suddenly fall again.

SUMMARY OF THE INVENTION

The aim of the present invention is to solve the above-described problem, eliminating the drawbacks of the cited prior art, by providing a safety device which can be applied to mechanisms for lifting a back of a chair or armchair which on the one hand allows an optimum vertical adjustment of the back and on the other hand allows to also provide the antipanic characteristic, in that the vertical sliding of the back is prevented in case of sudden movements imparted thereto.

Within the scope of this aim, an important object of the present invention is to provide a safety device which allows to achieve said antipanic condition, in that it prevents the upward and downward sliding of the back in case of sudden movements imparted thereto in these directions.

Another object of the present invention is to provide a device which is reliable and safe in use.

Another object of the present invention is to provide a safety device which is structurally simple.

Another object of the present invention is to provide a safety device which associates with the preceding characteristics that of being executable with conventional machines and equipment and of having low manufacturing costs.

This aim, these objects and others which will become apparent hereinafter are achieved by a safety device, particularly for mechanisms for lifting a back of a chair or armchair, which comprise a blade-shaped element protruding to the rear of, and above, a seat and is slidingly associated between a first supporting plate and a second supporting plate for said back; wherein said blade-shaped element has a first recess for a rack with two mutually opposite and offset sets of teeth, which interacts with a complementarily toothed ratchet element which cooperates with means for forcing the locking of the sliding of said blade-shaped element as a consequence of a sudden movement imparted to said back in an upward or downward direction.

Advantageously, the ratchet element is transversely accommodated in a second recess formed on said second plate and is allowed to move transversely in both directions, in contrast with a first flexible element which in turn interacts with a free pivot which is suitable to force the locking of the sliding of said blade-shaped element as a consequence of a sudden movement imparted to said back in an upward or downward direction.

BRIEF DESCRIPTION OF THE DRAWINGS

Further characteristics and advantages of the present invention will become apparent from the following detailed description of a particular but not exclusive embodiment thereof, illustrated only by way of non-limitative example in the accompanying drawings, wherein.

DESCRIPTION OF THE PREFERRED EMBODIMENTS

Figure 1:
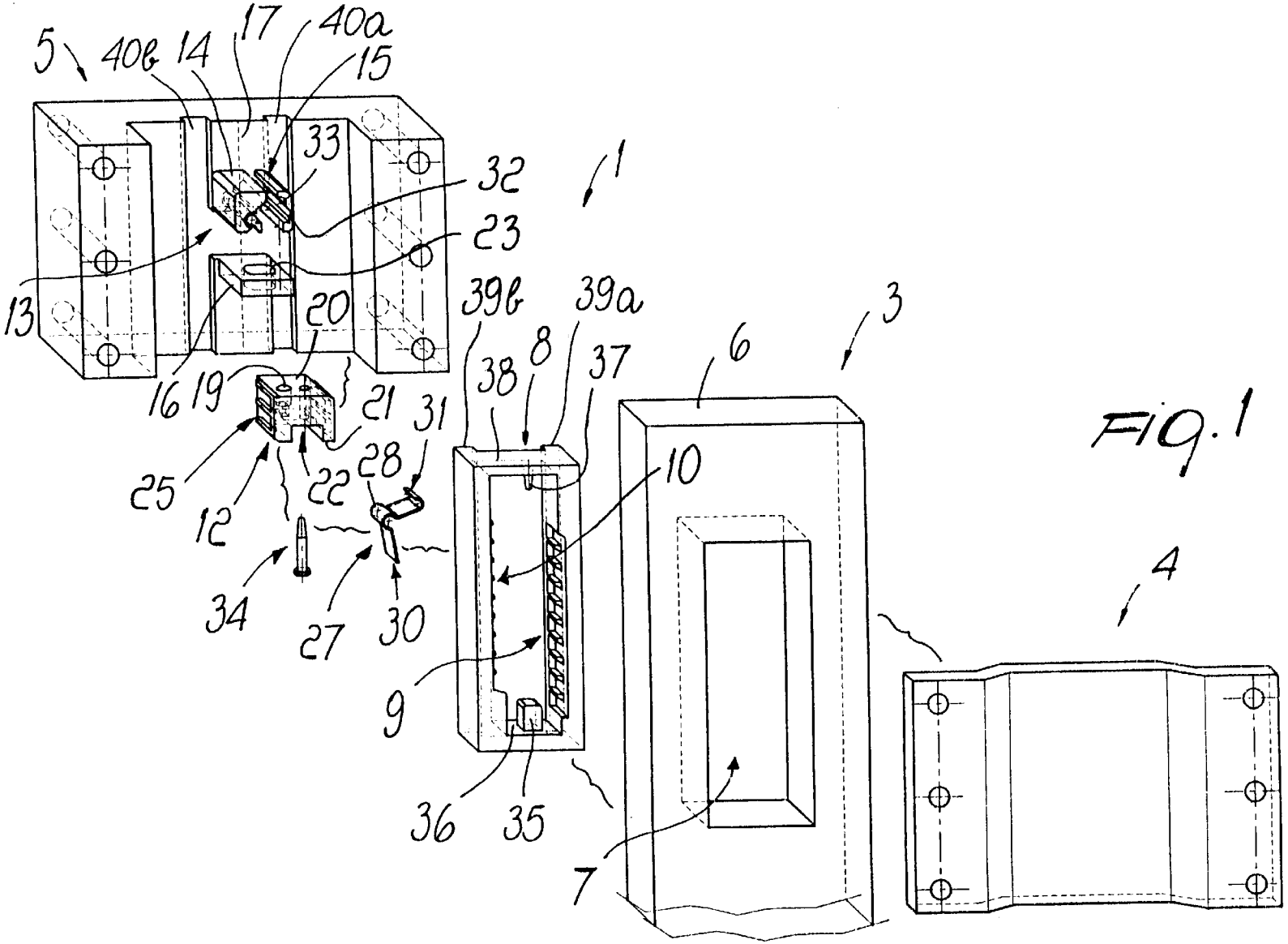
FIG. 1 is an exploded view of the components of the device according to the present invention.

With reference to the above figures, the reference numeral 1 designates the safety device, particularly usable for mechanisms for lifting a back 2 of a chair or armchair, of the kind comprising a blade-shaped element 3 which protrudes to the rear of, and above, a seat.

The blade-shaped element 3 is slidingly associated between a first plate 4, which is rigidly coupled to the rear of the back 2, and a second plate 5, which is in turn associated with the first plate 4.

An axial cutout 7 is formed at the blade-shaped element 3, proximate to its upper free end 6; the cutout is substantially rectangular, with sharp edges, and forms a first recess whereat a complementarily shaped rack 8 is associated; the rack 8 is shaped like a closed loop and is internally provided with first teeth 9 and second teeth 10 which constitute a double set of teeth and are mutually opposite and offset.

The first and second teeth 9,10 each have a cross-section shaped like a trapezoid, in which the sides 11*a*, 11*b* that join the parallel sides are slightly inclined with respect to a plane lying transversely to the blade-shaped element 3; the first and second teeth 9,10 are arranged in a mutually mirror-symmetrical fashion.

The width of the ratchet element 12, and therefore the width between the tips of the third teeth 24 and of the fourth teeth 25, is greater than the space between the tips of the first teeth 9 and of the second teeth 10; this forces a zigzag movement of the ratchet element.

A ratchet element 12 can be positioned at the cutout 7 and is accommodated at a suitable second recess 13, which is obtained by means of a first upper tab 14 and a second upper tab 15, which are arranged side by side, and by means of a third lower tab 16, all of which protrude from the base 17 of the second plate 5.

The ratchet element 12 has a box-like body provided with an upper wall 18, whereon a third recess 19 and a first through hole 20 are formed at right angles.

On the opposite side there is provided a planar lower wall 21 which is slidingly associated at the underlying third lower tab 16 and whereon a fourth recess 22 is formed along an axis which is perpendicular to the base 17.

A slot 23 is formed on the third lower tab 16, along an axis which is parallel to the base 17, and lies approximately below the fourth recess 22.

Third teeth 24 and fourth teeth 25 are formed laterally to the ratchet element 12, interact with the facing first teeth 9 and second teeth 10 of the rack, and are mirror-symmetrical with respect thereto, in that the sides 11*a* and 11*b* of the first and second teeth interact respectively with the sides 26*a* and 26*b* of the third and fourth teeth during the descent of the back and with the sides 26*b* and 26*a* of the third and fourth teeth during the ascent of the back.

The safety device is also constituted by a flexible element, which is constituted by a substantially V-shaped spring 27 which is freely rotatably associated, at the vertex 28, with the first upper tab at a suitable pivot 29 formed on said tab; said spring has a first end 30 accommodated at the underlying third recess 19 formed on the ratchet element 12.

The spring 27 also has a second end 31 which is advantageously curved and can be selectively associated at a first lower hollow 32 and at an adjacent second upper hollow 33, both whereof are formed on the facing surface of the second upper tab 15.

The arrangement of said second end 31 of said spring 27 at the first and second hollows is actuated by suitable means, constituted by a second pivot 34 which is slidingly associated, with friction, at the first hole 20 formed on the ratchet element 12; said first hole is arranged below said second end of said spring.

Figure 4:
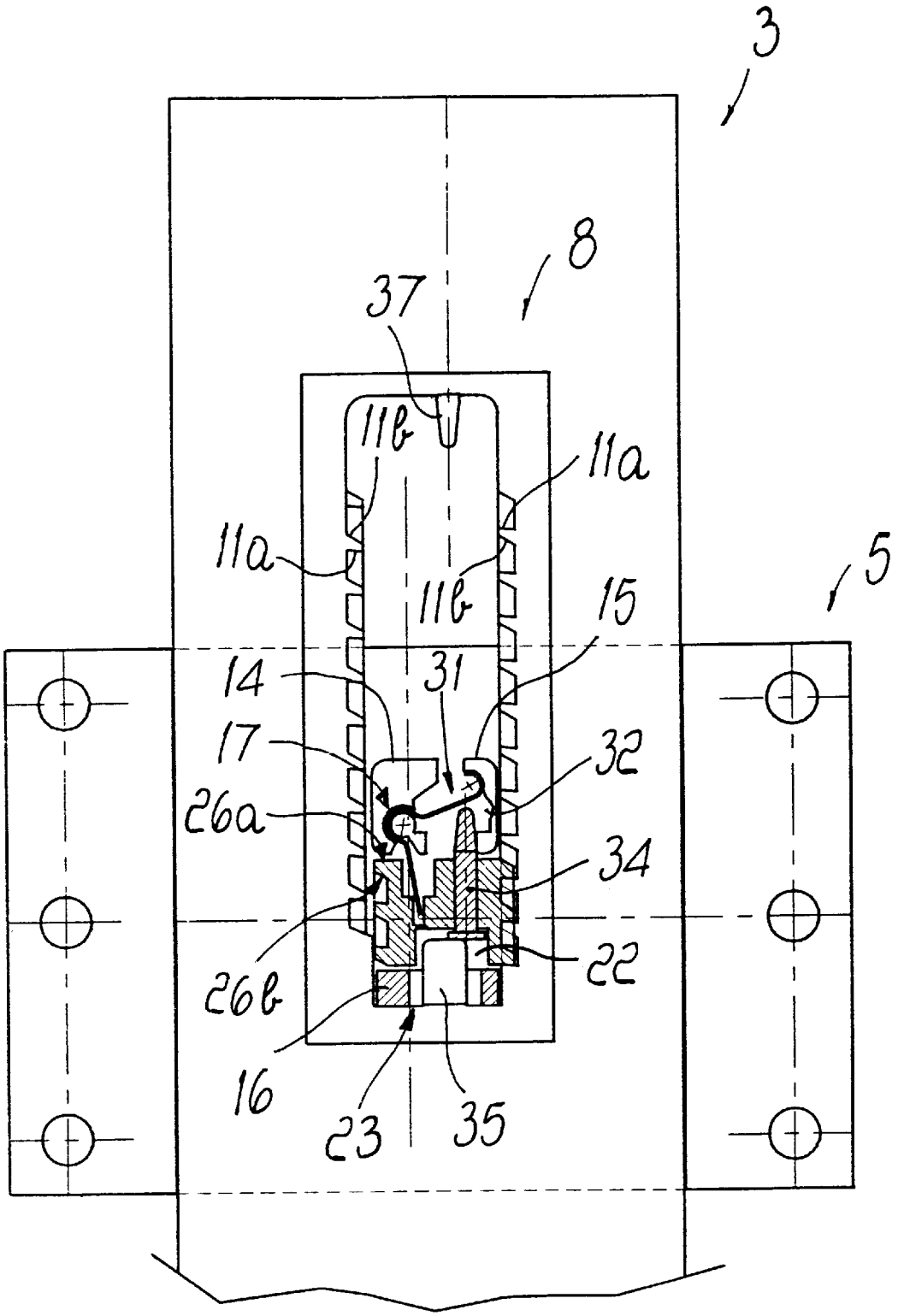
FIG. 4 is a partially sectional front view of the device in the lower stroke limit position of the back.

The dimensions of the second pivot 34 are such that once the ratchet element 12 has been positioned at the lower stroke limit shown in FIG. 4, there is a forced interaction with the second end 31 of the spring 27, forcing its transfer from the first hollow 32 to the second hollow 33 by virtue of the presence of a suitable fifth tooth 35, which protrudes axially and approximately centrally with respect to the end wall 36 of the rack 8; the fifth tooth is partially accommodated at the fourth recess 22 formed on the lower wall 21 of the ratchet element 12.

Figure 2:
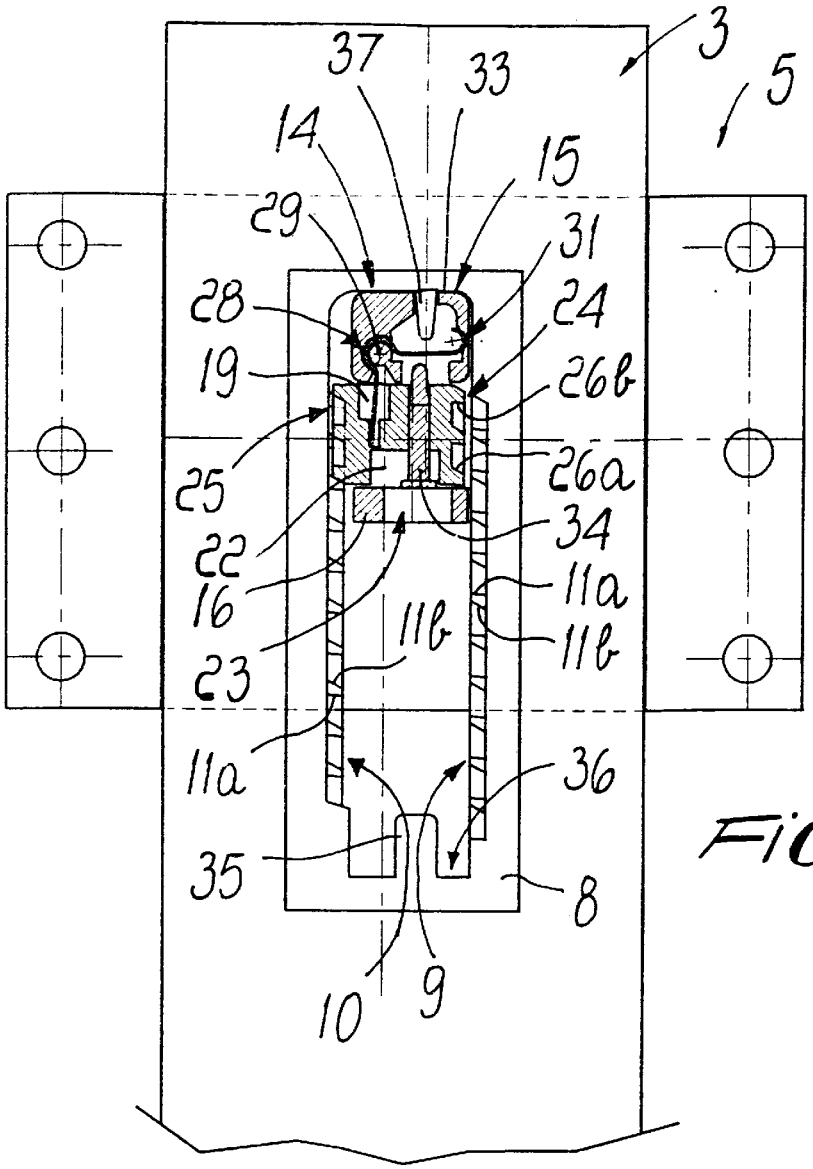
FIG. 2 is a partially sectional front view of the device in the upper stroke limit position of the back.
Figure 3:
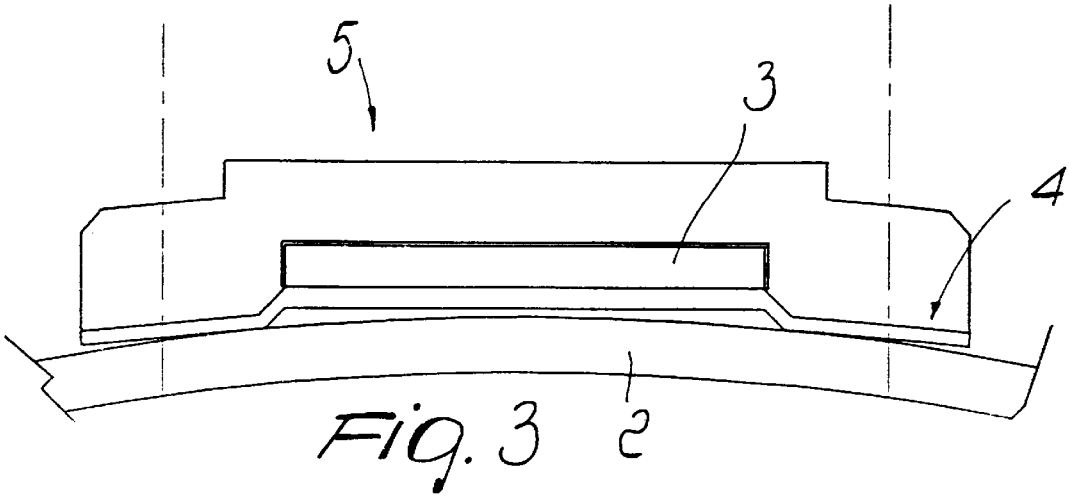
FIG. 3 is a top view of the back with the device applied thereto.

The second end 31 of the spring 27 is transferred from the second hollow 33 to the first hollow 32 if the ratchet element arrives at the upper stroke limit, shown in FIG. 2; transfer occurs by means of a third pivot 37 which protrudes axially from the upper base 38 of the rack 8.

The rack advantageously has, at the longitudinal sides 39*a*, 39*b* that face the base 17 of the second plate 5, ridges which are slidingly associated at suitable and complementarily shaped guides 40*a*, 40*b* formed on said base 17.

Figure 5:
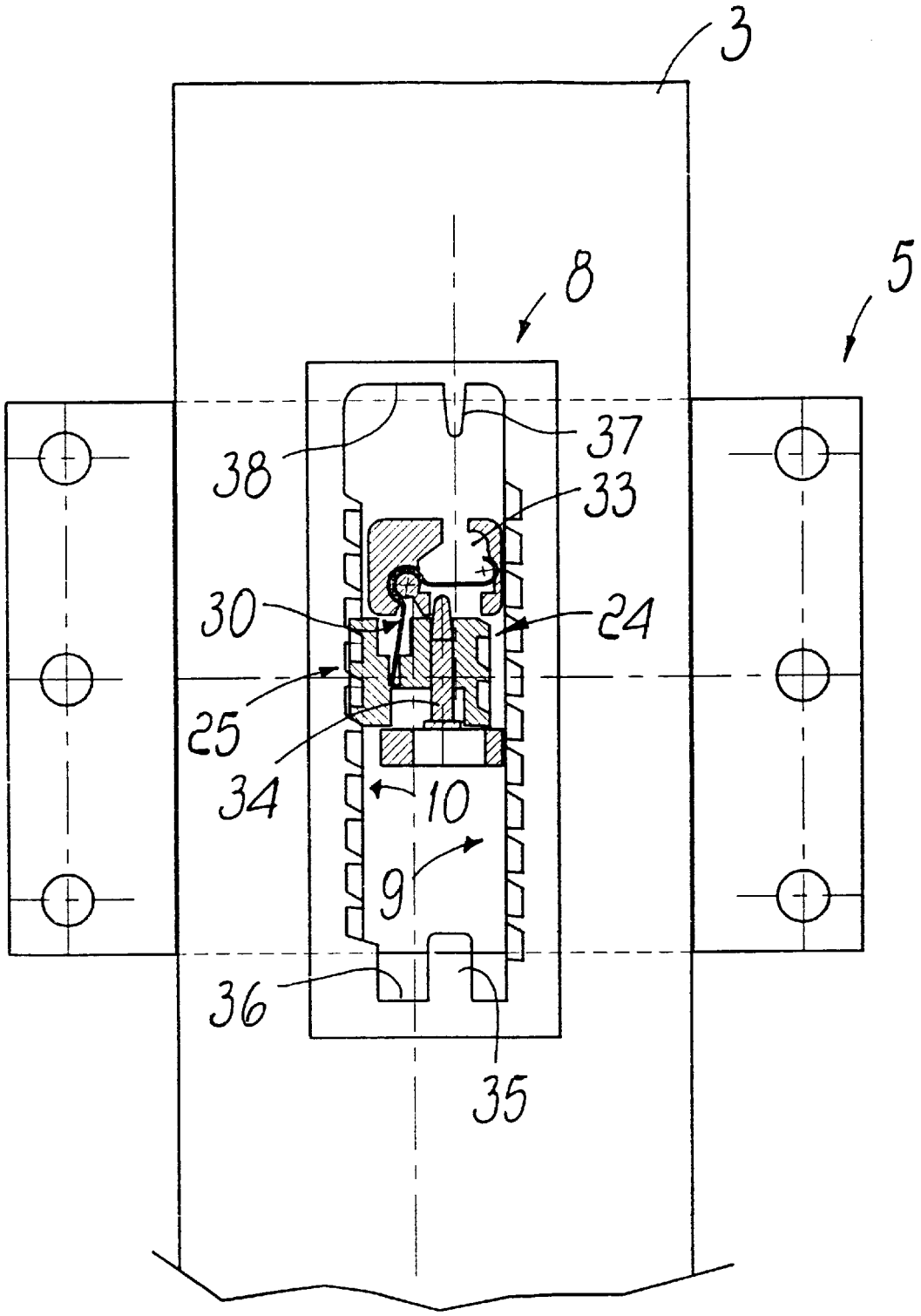
FIG. 5 is a partially sectional front view of the device in an intermediate active descending condition.

Depending on the arrangement of the second end 31 of the spring 27 in the first or second hollow, the first end 30 of said spring pushes the ratchet element 12 in one direction or the other; in the active descending condition, shown for example in FIG. 5, the second end 31 is accommodated at the first hollow 32 and therefore the first end 30 of the spring 27 pushes the ratchet element 12 so that it interacts with the set of teeth of the rack 8 which is adjacent to the side where the first upper tab 14 is located.

The particular configuration of the second teeth 10 and of the fourth teeth 25 allows to achieve the transverse movement of the ratchet element 12 with respect to the rack 8, achieving step-by-step lowering of the back.

Figure 6:
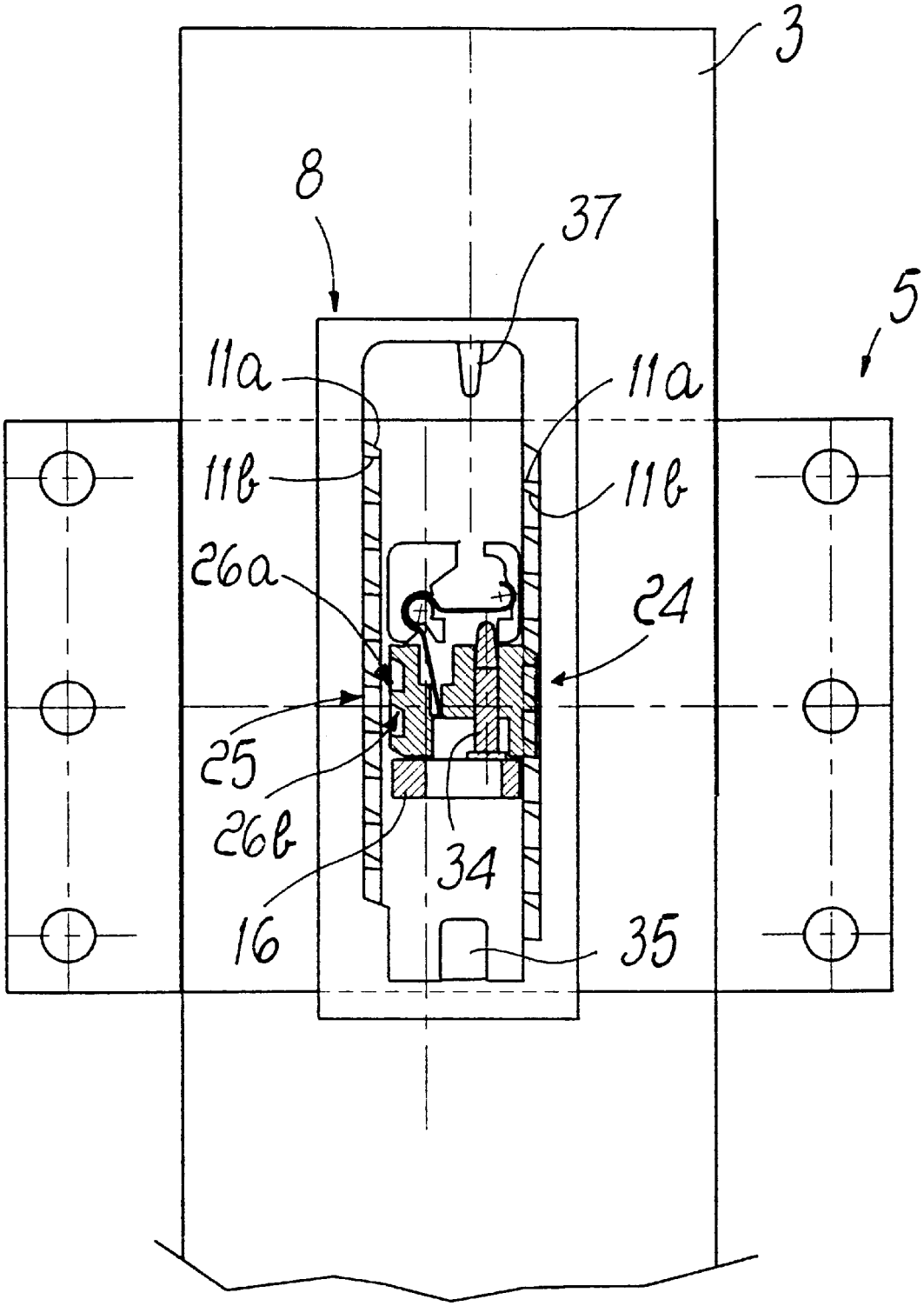
FIG. 6 is a view, similar to FIG. 5, of the device in an antipanic descending condition.

If a sudden downward motion is applied, one obtains, as shown in FIG. 6, the interaction between the sides 11*a* of the first teeth 9 and the sides 26*a* of the third teeth 24 and therefore, owing to their configuration, the locking of the ratchet element 12, consequently achieving the antipanic condition, since the back is no longer subjected to any downward motion.

Once the lower stroke limit, shown in FIG. 4, has been reached, the fifth tooth 35 pushes the second pivot 34, which is friction-coupled in the first hole 20, into contact with the wing of the spring provided with the second end 31, which is forced to shift from the first lower hollow 32 to the second upper hollow 33.

In this manner, the first end 30 of the spring 27 pushes the ratchet element 12 so that the third teeth 24 interact with the first teeth 9, thus allowing to lift the back.

Figure 7:
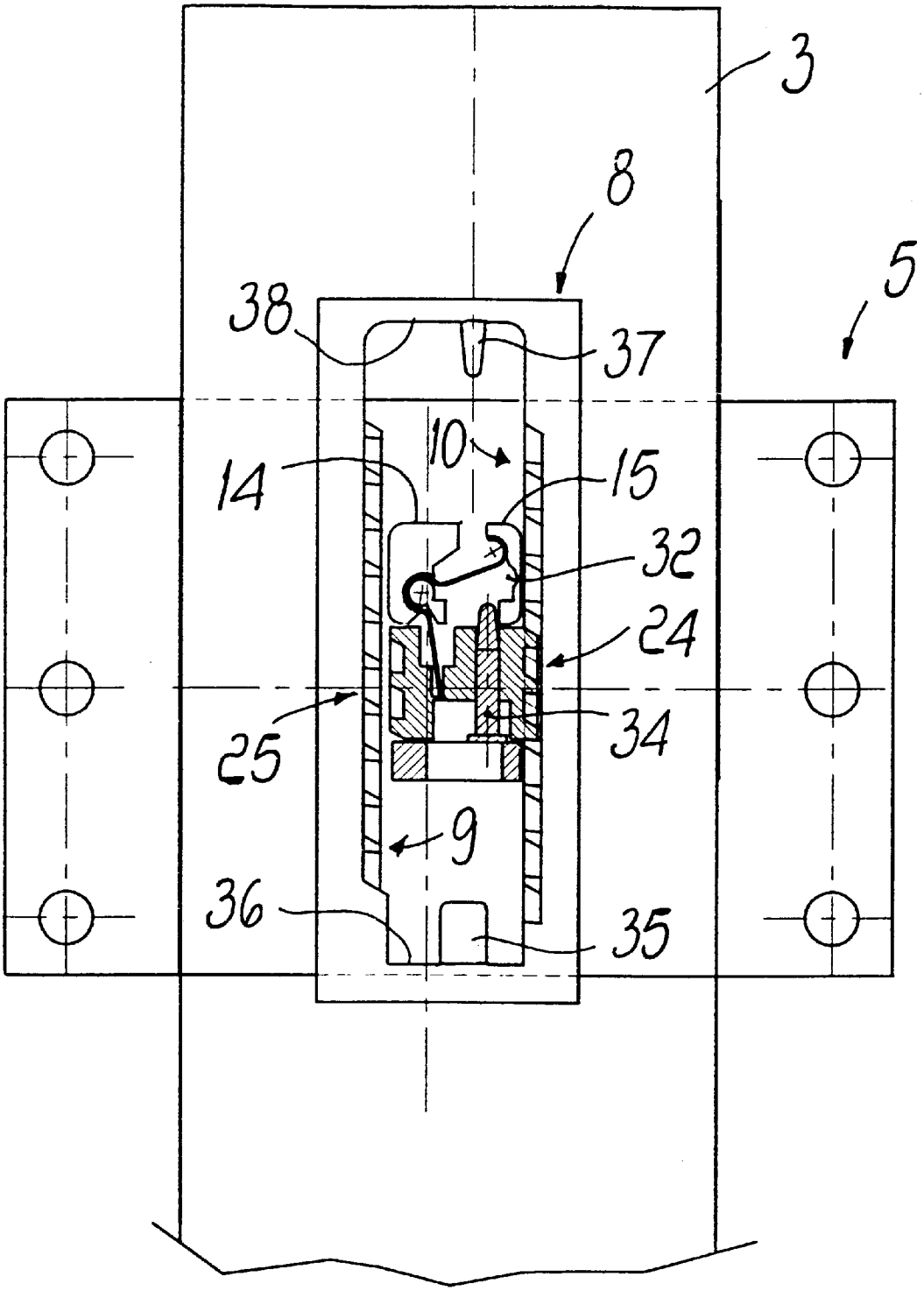
FIG. 7 is a partially sectional front view of the device in an intermediate active rising condition.

A rising active midpoint of the back is shown in FIG. 7; in said midpoint, owing to the configuration of the sides 26*a* and 11*b*, respectively, of the fourth teeth and of the first teeth 9, a transverse movement of the ratchet element 12 with respect to the rack 8 and the step-by-step lifting of the back with respect to said rack are obtained.

Figure 8:
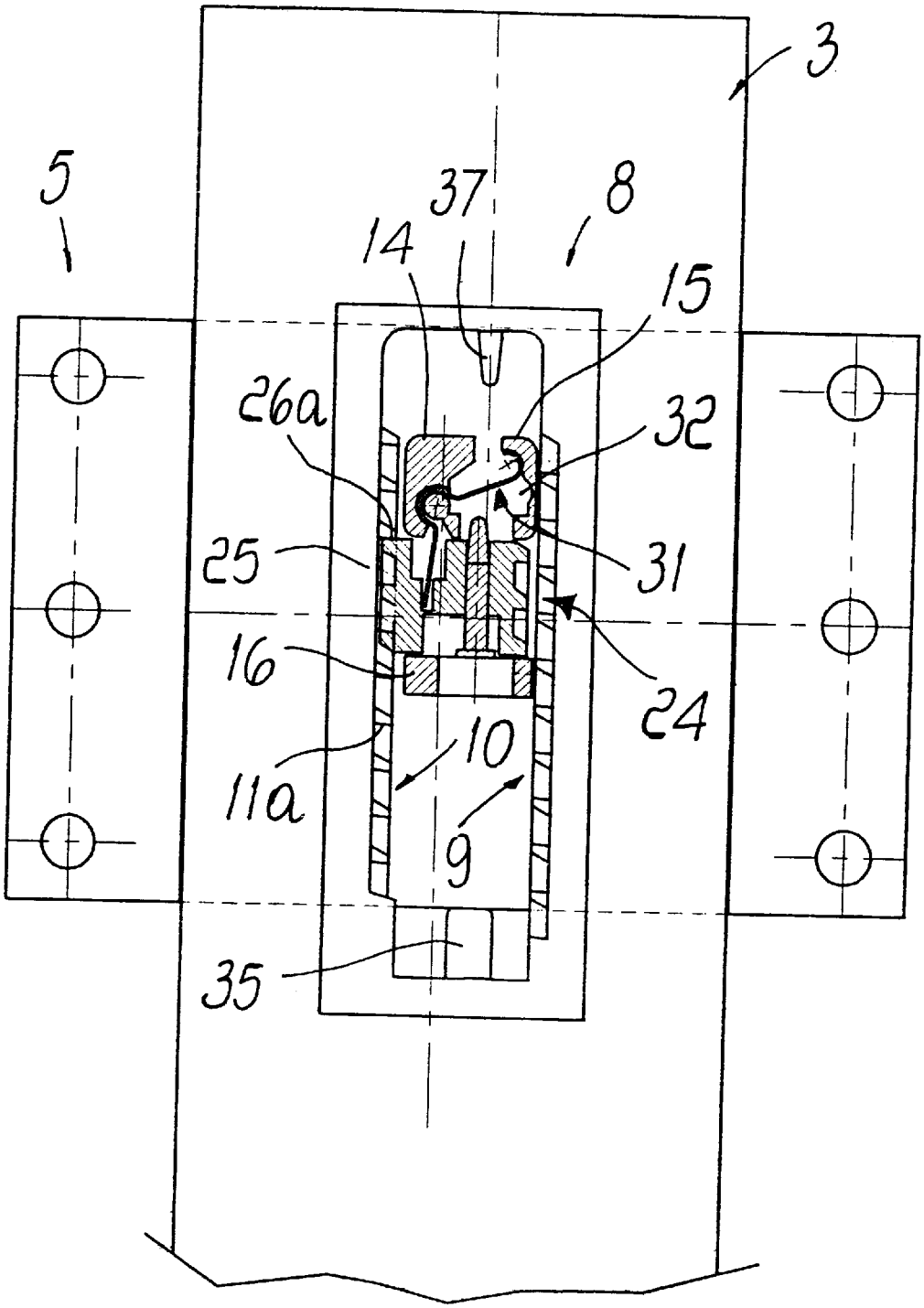
FIG. 8 is a view, similar to FIG. 7, of the device in antipanic rising condition.

The rising antipanic condition is shown in FIG. 8: any sudden lifting of the back leads to a shift of the ratchet element 12, which makes the fourth teeth 25 interact with the second teeth 10, specifically coupling the sides 26*a* and 11*a* and in practice blocking any possible upward movement of the back.

It has thus been observed that the present invention has achieved the intended aim and objects, a device having been provided which, when applied to back lifting mechanisms, allows to achieve step-by-step adjustment of the preset height of the back with respect to the seat and also allows to achieve antipanic safety, blocking the vertical movement of the back in case of sudden upward and downward movements.

The device can also be deactivated simply and quickly and allows to reposition the back in the intended condition once the sudden movement has ceased.

The device is of course susceptible of numerous modifications and variations, all of which are within the scope of the same inventive concept.

The materials and the dimensions that constitute the individual components of the device may of course also be the most pertinent according to specific requirements.

What is claimed is:

1. A safety device, for chairs or armchairs provided with back lifting mechanisms, which comprises a blade-shaped element adapted to protrude to the rear of, and above, a seat and is slidingly associated between a first supporting plate and a second supporting plate for said back; wherein said blade-shaped element has a first recess for a rack with two mutually opposite and offset sets of teeth, which interacts with a complementarily toothed ratchet element that is also provided with two mutually opposite sets of teeth and which cooperates with means for forcing a locking of the sliding of said blade-shaped element as a consequence of a sudden movement imparted to said back in an upward or downward direction.

2. The device according to claim 1, wherein said ratchet element is transversely accommodated within a second recess formed on said second plate, said ratchet element being allowed to move transversely with respect to a longitudinal extension of said two sets of teeth in contrast with a first flexible element, which in turn interacts with a free pivot which is suitable to force a locking of the sliding of said blade-shaped element as a consequence of a sudden movement imparted to said back in an upward or downward direction.

3. The device according to claim 1, further comprising means which allow to release the sliding of said blade-shaped element as a consequence of a sudden movement imparted to said back in an upward or downward direction.

4. The device according to claim 1, wherein said blade-shaped element has, proximate to its upper free end, an axial cutout which is substantially rectangular with sharp edges and forms said first recess whereat said complementarily shaped rack is associated; wherein said rack is a closed loop and is internally provided with first teeth and second teeth which constitute said two sets of teeth which are mutually opposite and offset, each one of said first and second teeth having a trapezoidal cross-section, in which sides that join parallel sides are slightly inclined with respect to a plane lying transversely to said blade-shaped element, said first and second teeth being arranged in a mirror-symmetrical fashion with respect to each other.

5. The device according to claim 4, wherein said ratchet element is arranged at said cutout and is accommodated at a second recess formed by means of a first upper tab and a second upper tab, which are arranged mutually side by side, and by a third underlying lower tab, all of which protrude from a base of said second plate.

6. The device according to claim 5, wherein said rack has, at longitudinal sides that face the base of said second plate, ridges which are slidingly associated at complementarily shaped guides formed on said base.

7. The device according to claim 4, wherein said ratchet element has a box-shaped body provided with an upper wall whereon an underlying third recess and a first through hole are formed at right angles, a planar lower wall being provided on an opposite side with respect to said upper wall and being slidingly associated at said underlying third lower tab, a fourth recess being formed thereon along an axis which is perpendicular to the base of the second plate.

8. The device according to claim 7, wherein a slot is formed on said third lower tab, along an axis which is parallel to the base of the second plate, and lies below said fourth recess.

9. The device according to claim 6, wherein said two sets of teeth of the ratchet element are third and fourth teeth which are provided laterally to said ratchet element, interact with said facing first and second teeth of said rack, and are mirror-symmetrical with respect thereto, wherein each one of said inclined sides that connect bases of said first and second teeth interacts with the inclined side that joins bases of said third and fourth teeth during descent and ascent.

10. The device according to claim 9, wherein the shape of said second and fourth teeth allows a transverse movement of said ratchet element with respect to said rack, achieving a step-by-step lowering of said back in the absence of sudden movements.

11. The device according to claim 9, further comprising at least one flexible element, which is constituted by a substantially V-shaped spring which is rotatably freely associated, at its vertex, with said first upper tab at a pivot which is formed therein and protrudes therefrom, said spring having a first end which is accommodated at said underlying third recess formed on said ratchet element.

12. The device according to claim 11, wherein said spring has a second end which is advantageously curved and can be selectively associated at a first lower hollow and at a second adjacent upper hollow, both whereof are formed on the facing surface of said second upper tab.

13. The device according to claim 12, wherein the second end of said spring is associated at said first and second hollows by a second pivot which is slidingly associated, with friction, at said first hole formed on said ratchet element, said first hole being arranged below said second end of said spring.

14. The device according to claim 12, wherein the dimensions of said second pivot are such that once said ratchet element has been positioned at a lower stroke limit, they force interaction with said second end of said spring, forcing its transfer from said first hollow to said second hollow by virtue of the presence of a fifth tooth which protrudes axially and approximately centrally with respect to an end wall of said rack, said fifth tooth being partially accommodated at said fourth recess formed on the lower wall of said ratchet element.

15. The device according to claim 12, wherein, if a sudden downward movement is imparted, sides of said first and third teeth that are directed toward said end wall of said rack mutually interact and, by virtue of their configuration, force a blocking of said ratchet element.

16. The device according to claim 14, wherein the second end of the spring is forced to move from said second hollow to said first hollow by means of a third pivot which protrudes axially from an upper base of said rack in a position in which said ratchet element reaches the upper stroke limit.

17. The device according to claim 16, wherein the second end of said spring, in a condition in which said ratchet element is at the lower stroke limit, is forced to pass from said first hollow to said second hollow by means of said fifth tooth, which pushes said second pivot, which is friction-coupled in said first hole, into contact with said wing of said spring provided with said second end, so that said first end of said spring pushes said ratchet element so that said third teeth interact with said first teeth, so as to allow a subsequent lifting of said back.

18. The device according to claim 4, wherein the shape of said first and third teeth allows a transverse movement of said ratchet element with respect to said rack, achieving a step-by-step lifting of said back in the absence of sudden movements.

* * * * *